United States Patent [19]

Brandeau et al.

[11] 4,225,208

[45] Sep. 30, 1980

[54] CABLE-CONNECTOR ASSEMBLY WITH HIGH DENSITY GROUND TERMINAL

[75] Inventors: Edward P. Brandeau, Willimantic, Conn.; John M. Gentry, Asheville, N.C.

[73] Assignee: Akzona Incorporated, Asheville, N.C.

[21] Appl. No.: 25,284

[22] Filed: Mar. 29, 1979

[51] Int. Cl.[3] ..... H01R 4/10

[52] U.S. Cl. ..... 339/95 R; 339/176 MF; 339/210 M; 339/276 T

[58] Field of Search ..... 339/97 R, 97 P, 98, 339/99 R, 275 R, 275 L, 275 T, 276 R, 276 C, 276 F, 276 S, 276 T, 276 C

[56] References Cited

U.S. PATENT DOCUMENTS

| | | | |
|---|---|---|---|
| 3,405,385 | 10/1968 | Rapp | 339/97 R |
| 3,656,088 | 4/1972 | Seim | 339/98 |
| 4,035,050 | 7/1977 | Voliwskie | 339/99 R |
| 4,099,822 | 7/1978 | Carlisle et al. | 339/98 |
| 4,173,388 | 11/1979 | Brandeau | 339/276 T |

*Primary Examiner*—John McQuade

*Attorney, Agent, or Firm*—Leydig, Voit, Osann, Mayer & Holt, Ltd.

[57] ABSTRACT

A cable-connector assembly of the type having wires progressively forced into plate slots, in which a common bus plate has slots along opposite edges that are offset and hour-glass shaped so that a high wire density from either side of the plate can be terminated in the slots. The assembly also includes two parallel arrays of pin sockets having slotted, slightly offset termination plates. The plates of each array are offset in opposite directions and brought to a common plane to receive their respective wires.

2 Claims, 8 Drawing Figures

CABLE-CONNECTOR ASSEMBLY WITH HIGH DENSITY GROUND TERMINAL

This invention relates generally to electrical connector-cable assemblies and more particularly concerns a connector assembly for terminating very closely spaced ground wires.

Flat multi-wire cables are commonly used to interconnect printed circuit boards and/or other components in computer assemblies and the like. A typical such cable includes 22 signal wires on 0.05" centers, each flanked by two ground wires, making a total of 66 wires in the flat cable. The connector for such cable must place the closely spaced signal wires on 1/10" centers for mating with circuit board pins, as well as tie the ground wires to one or more pin sockets.

A particularly effective and economical technique of making such high wire-density electrical terminations is shown in U.S. Pat. No. 4,173,388 issued Nov. 6, 1979. It is the primary aim of the present invention to utilize that technique in an improved wire-connector assembly which terminates a large number of closely spaced wires in a short, flat connector.

An object of the invention is to provide, for an assembly of the above kind, a ground bus plate capable of terminating up to twice as many wires as prior designs without spreading or substantially altering the positioning of the wires from their cable.

Another object is to provide a wire-slotted plate termination that allows the wire to engage the termination slots from either end of the slot so that both parallel edges of a termination plate can be slotted to receive and terminate wires.

A further object is to provide an assembly as characterized above that simplifies tooling for making the terminations by locating the termination points for the pin sockets in substantially the same plane.

Other objects and advantages of the invention will become apparent upon reading the following detailed description and upon reference to the drawings, in which.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
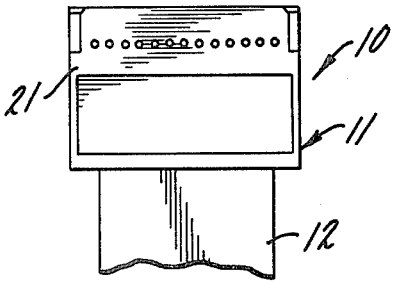
FIG. 1 is a plan view of a cable-connector assembly embodying the invention.
Figure 2:
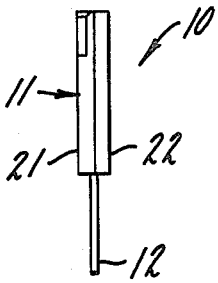
FIG. 2 is a side elevation of the cable-connector assembly as shown in FIG. 1.
Figure 3:
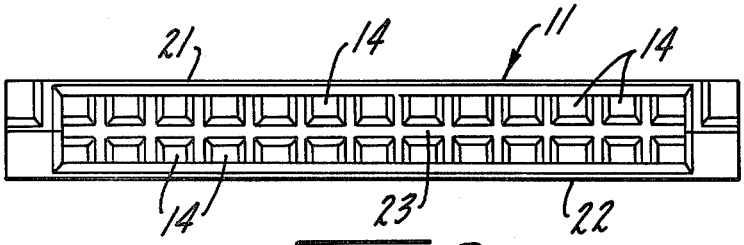
FIG. 3 is an enlarged end view of the connector shown in FIGS. 1 and 2.
Figure 6:
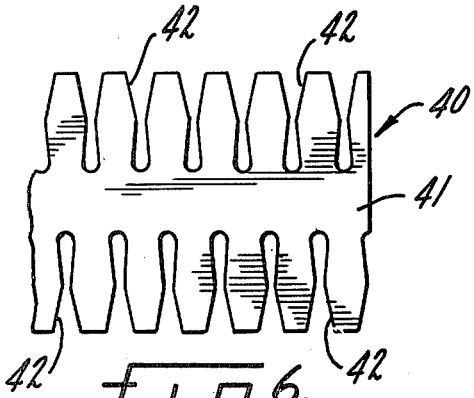
FIG. 6 is an enlarged fragmentary plan of a portion of the structure embodied in the cable-connector assembly.

Turning to FIGS. 1 and 2, there is shown an assembly 10 embodying the invention including a connector 11 and a flat cable 12 having, in the illustrated embodiment, sixty-six parallel wires 13. The connector 11 includes twenty-six pin sockets 14 and two parallel arrays of thirteen sockets each. There are twenty-two signal wires 13 in the cable 12, each flanked by two shield or ground wires 13, and each signal wire is connected to one of the sockets 14 with all of the ground wires being electrically connected to four remaining sockets which are scattered through the socket pattern.

Figure 5:
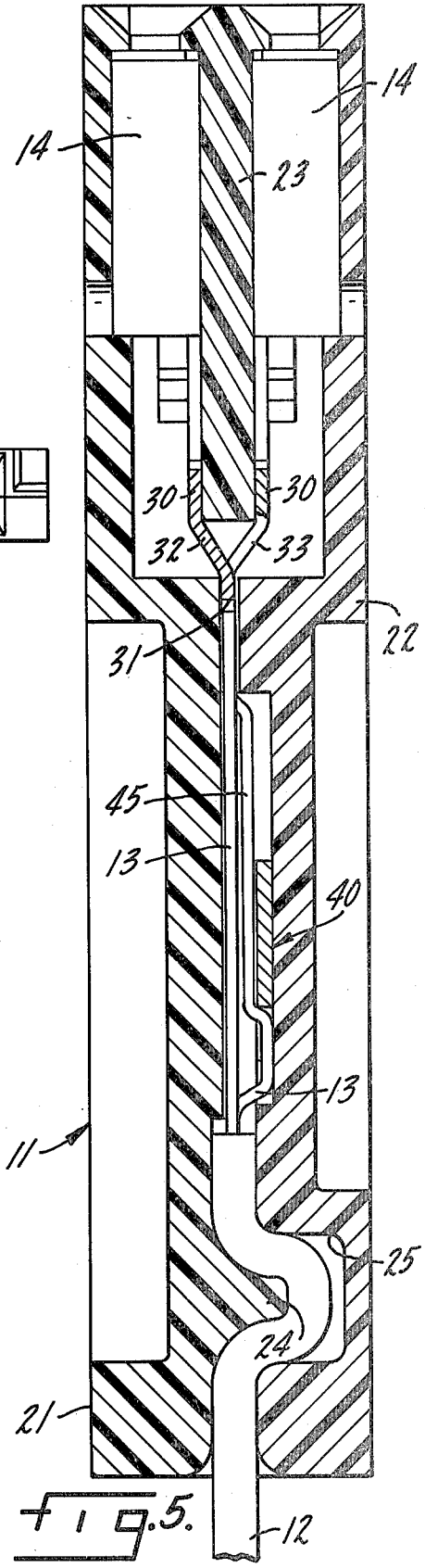
FIG. 5 is a section taken through the connector of FIG. 4.
Figure 4:
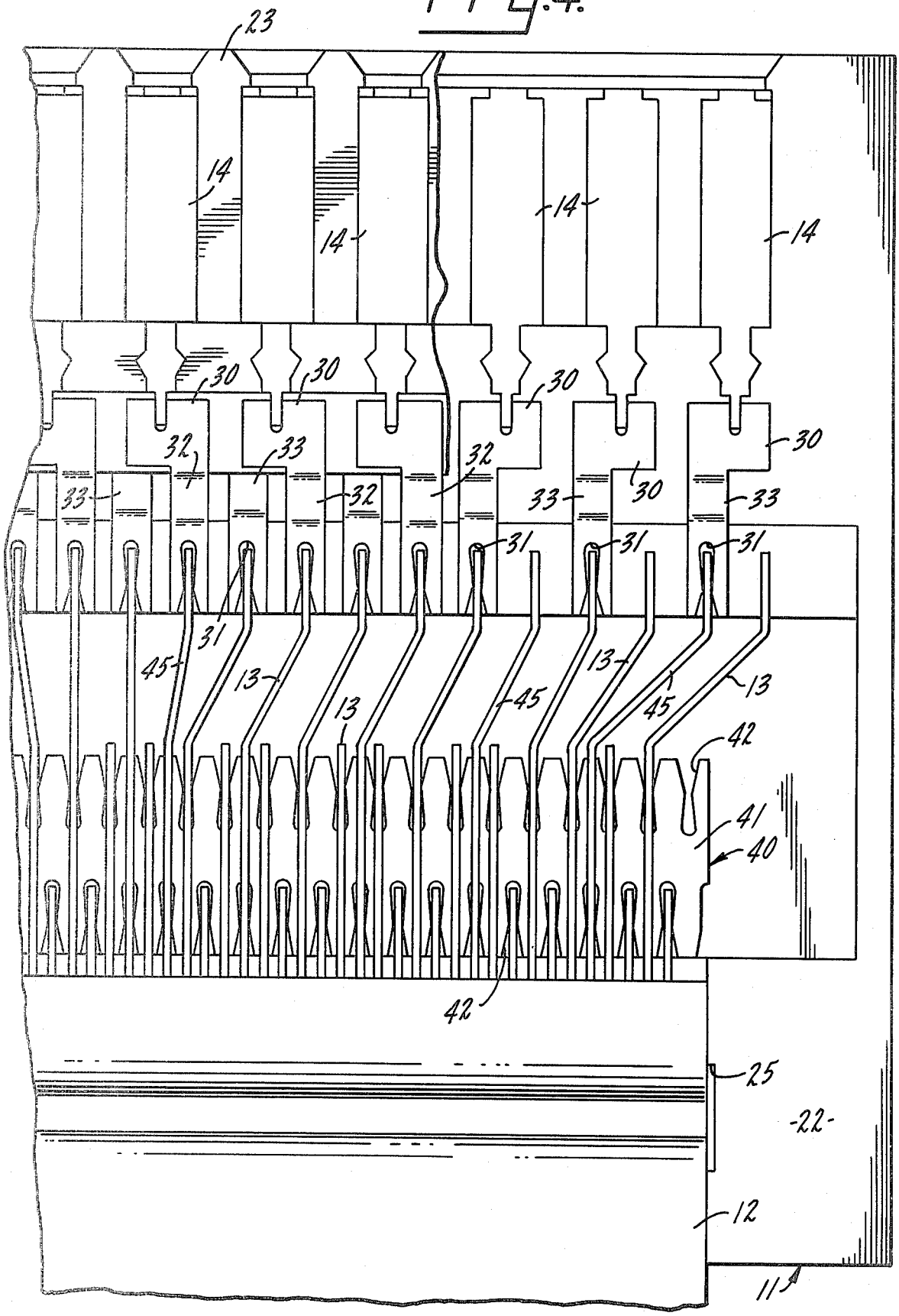
FIG. 4 is a greatly enlarged, fragmentary and partially broken away plan view of portions of the connector appearing in FIGS. 1 and 2.

The connector 11 includes upper and lower housing halves 21 and 22, upper and lower as seen from the right side of FIGS. 2 and 5, which sandwich a housing block 23 and which lock the cable by means of the rib 24 on the upper housing half 21 forcing the cable into a locking, U-shape fitted within a slot 25 in the lower housing half. The pin sockets 14 are fitted in recesses between the housing block 23 and the respective upper and lower housing halves 21, 22.

As a feature of the invention, separate plate members 30 are secured to the sockets 14 having slots 31 in slotted portions 32 and 33 offset from the center line of the respective sockets, the slotted portions 32 associated with the sockets in one array being offset in the same direction and the slotted portions 33 associated with the sockets in the other array all being offset in the opposite direction. The plate members 30 are slightly bent, all in the same direction, but because of the opposite disposition of the slotted portions 32, 33, this places all of the slotted portions in the same plane (see FIG. 5) closely adjacent one another and within the spacing of the sockets 14.

In carrying out the invention, the plurality of ground wires 13 in the cable 12 are terminated at a single bus plate 40 having an elongated body 41 with opposite termination edges formed with slots 42 offset with respect to one another, the slots 42 having an hour-glass shape with the pinched portion of that shape having a width somewhat narrower than the wires to be terminated. With the slots 42 being of this shape, the ground wires 13 can be forced with downward progressive pressure longitudinally into respective ones of the slots in the manner, and to produce the termination connection, disclosed in some detail in said U.S. Pat. No. 4,173,388, starting from either end of the slot. The hour-glass shape gives the tapering throat, discussed in said application, from either end of the slot, and thus a large number of wires, forty-four in the illustrated case, can be terminated on the common plate 40 with the wires at their cable center-to-center spacing. In describing this termination procedure, the term slot means either a depression or an aperture, so long as it has the stated configuration.

The plate 40 is fitted into the lower housing half 22 below the plane of the cable 12 (see FIG. 5) so that the signal wires 13 can pass over the plate to the slotted socket plate portions 32, 33 where they are similarly terminated in the similarly formed slots 31. Because all of the portions 32, 33 are in the same plane, tooling for the termination step is simplified. Certain ones of the ground wires 13 are not cut short, so as to leave ends 45 that are extended from the bus plate 40 and are again terminated to selected ones of the pin sockets. This electrically connects all of the ground wires to the selected pin sockets.

Figure 7:
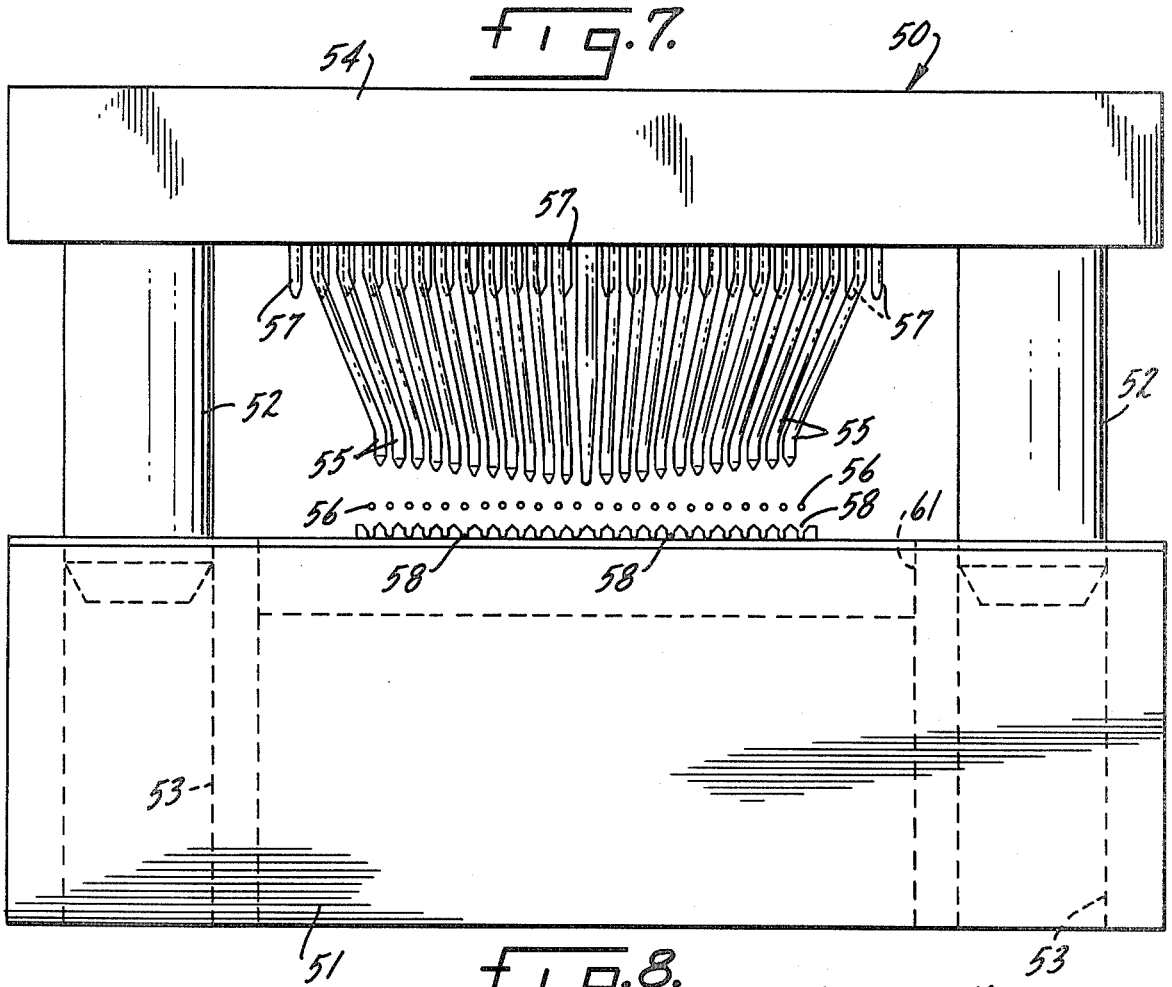
FIG. 7 is an elevation of a tool for bending wires into a predetermined pattern.
Figure 8:
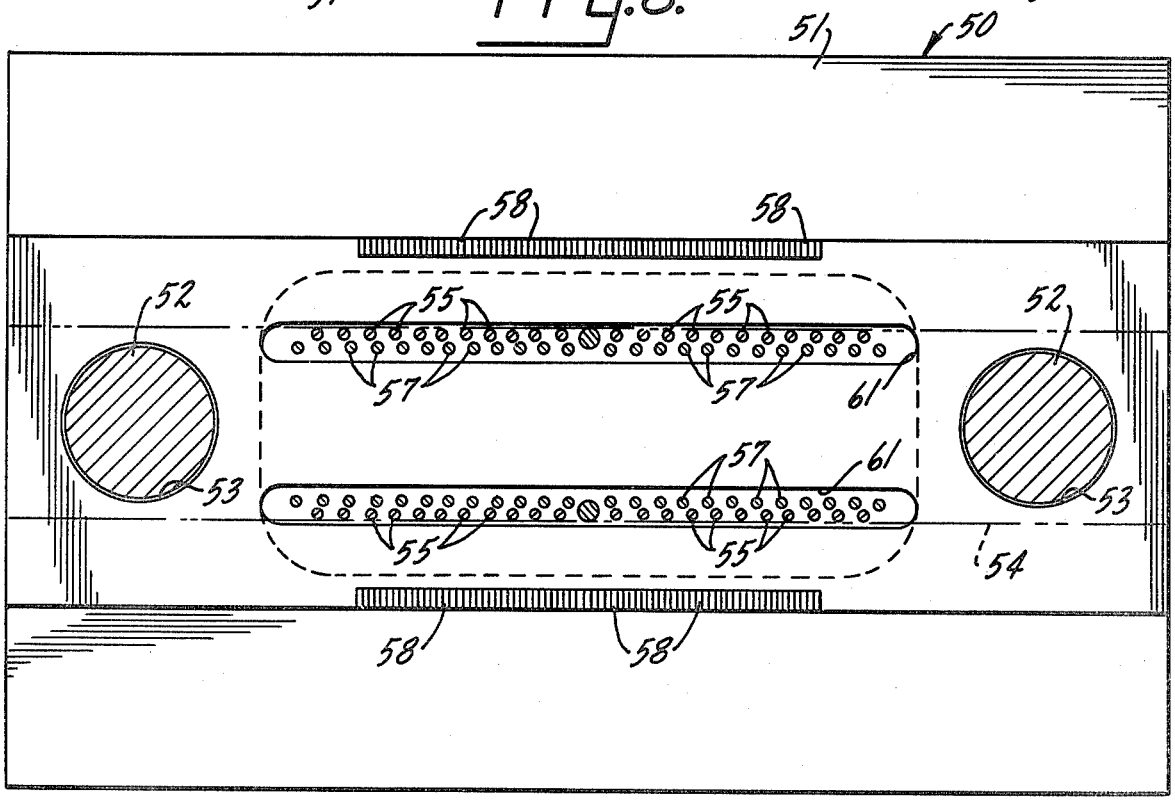
FIG. 8 is a horizontal section of the tool shown in FIG. 7.

As mentioned above, the ground wires 13 are terminated at the bus plate 40 at their cable spacing, but those wires proceeding to the socket plate members 30 must be spread laterally to the proper pattern. This may be done by the tool 50 (see FIGS. 7 and 8) having a base 51 guiding, through columns 52 sliding in holes 53, a vertically movable spreader 54. The spreader 54 includes a plurality of spreader pins 55 mounted in rows and formed so that their lower open ends fit between the cable-spacing of a plurality of wires 56 that are to be spread, and whose upper mounting ends cooperate with short final spacing pins 57 to define the desired wire spread configuration.

The wires 56 are bent between the rows of pins 55 and holding notches 58 longitudinally spaced along the wires from the pins. In operation, the wires 56, stripped from their cable, are fitted in the notches 58 to underlie the lower ends of the pins 55. The spreader 54 is moved down with the pins 55 passing between the wires 56 and into recesses 61 formed in the block 51. As the pins 55 move down, they cam the wires 56 outwardly from the original wire positions, retained by the notches 58, to a final position adjacent the final spacing pins 57.

It will have been noted that the spreader and final spacer pins 55, 57 and the holding notches 58 have been duplicated at each side of the tool 50. In this way, a flat multi-wire cable can be partially stripped, leaving a piece of insulation at the end of the cable holding the wires in controlled relative positions. The stripped portion of the wires is then placed across the sets of notches 58 and the portions of wire between those notches will be bent out by the tool 50 to the positions dictated by the pins 55, 57, whereupon the wires are severed at some point between the rows of pins 57 to produce, at the end of the cable, the desired fanned out pattern.

The operation of the tool 50 on the wires 56 is exemplary and is not intended to illustrate the precise spread pattern of the wires 13 in the connector 11.

We claim:

1. In a wire termination assembly, a plate member for terminating a plurality of parallel wires from a cable, comprising an elongated body having opposite termination edges, each of said edges being slotted in an hourglass shape with the pinched portion of said shape having a width somewhat narrower than the wires to be received, said slots at the opposite edges being offset with respect to one another.

2. A cable-connector assembly comprising, in combination, a housing, an upper and a lower array of pin sockets mounted in said housing, each of said sockets having plate members electrically secured thereto, a flat cable having a plurality of wires spaced in one plane, said plate members each having a slotted portion offset from the center line of the respective sockets with the slots being somewhat narrower than one of said wires, said slotted portions associated with the sockets in one array being offset in the same direction and the slotted portions associated with the sockets in the other array being all offset in the opposite direction, and said plate portions all being disposed in the same plane in side-by-side relation and receiving, in said slots, wires from said cable.

* * * * *